US007632122B2

(12) United States Patent
Pesant

(10) Patent No.: US 7,632,122 B2
(45) Date of Patent: Dec. 15, 2009

(54) EMI FILTERING COAXIAL POWER CONNECTOR

(75) Inventor: Gilbert Pesant, Mascouche, CA (US)

(73) Assignee: Electroline Equipment Inc., Anjou, QC (CA)

( * ) Notice: Subject to any disclaimer, the term of this patent is extended or adjusted under 35 U.S.C. 154(b) by 0 days.

(21) Appl. No.: 12/150,286

(22) Filed: Apr. 28, 2008

(65) Prior Publication Data

US 2009/0269984 A1 Oct. 29, 2009

(51) Int. Cl.
*H01R 29/00* (2006.01)

(52) U.S. Cl. ..... 439/188

(58) Field of Classification Search ..... 439/620, 439/188, 944; 333/184, 185, 186, 260
See application file for complete search history.

(56) References Cited

U.S. PATENT DOCUMENTS 3,719,918 A * 3/1973 Kerr ..... 439/319
5,730,612 A * 3/1998 Tatsuzuki ..... 439/188

* cited by examiner

*Primary Examiner*—Phuong K Dinh

(57) ABSTRACT

An EMI filtering coaxial power connector that is comprised of an open ended conductive outer shell, a conductive member, an interior dielectric support that holds the conductive member, an EMI filtering component, and a closure member ("CM"); in which the interior dielectric support is held within the conductive outer shell and the conductive member is held within the interior dielectric support, and in which the CM has an inner conductive area with a central opening and an inner non-conductive area outward of the inner conductive area, which inner non-conductive area has an outer conductive area outward of it, which outer conductive area has an outer non-conductive area outward of it, and in which the outer perimeter of the CM fits within the output end of the conductive outer shell such that the output end of the conductive member is through the central opening in the CM and the outer conductive area of the CM is conductively connected to the conductive outer shell, and the CM's inner conductive area is conductively connected to the conductive member, and the EMI filtering component is conductively connected between the inner and outer conductive areas of the CM.

10 Claims, 6 Drawing Sheets

EMI FILTERING COAXIAL POWER CONNECTOR

TECHNICAL FIELD

This invention relates generally to connectors for providing electrical power, either alternating current ("AC") or direct current ("DC"), to electronic devices; more specifically this invention relates to power supply connectors which are designed to be attached to a Printed Circuit Board ("PCB") and other electronic devices that operate at radio-frequencies.

BACKGROUND ART

Electronic devices require power to operate. Many electronic devices operate at radio frequencies and can be adversely affected by electromagnetic interference ("EMI") that gets into the device through the device's power connection. In addition, some sophisticated modern electronic devices operate at relatively low power levels and that can make them even more susceptible to EMI.

Radiated EMI, which comes from electronic devices, travels by being radiated beyond the physical boundaries of the device and things and connections that are physically connected to the device. Having left the physical boundaries of the device radiated EMI can potentially enter all electronic devices that are within its range.

Conducted EMI, which comes from a specific electronic device, can travel through the device's conductive elements and through the conductive elements of things and connections that are physically connected to the device; and therefore potentially to other electronic devices that have a physical connection with that specific electronic device.

Therefore, EMI originating outside of an electronic device can be a problem for the electronic device if it gets into the electronic device; and EMI originating in an electronic device can be a problem for other electronic devices when it leaves the electronic device.

Placing a filtering component or circuit on an electronic device's circuit board is a known solution to reducing incoming and/or outgoing EMI, however, that requires more components on the circuit board, which is a disadvantage in sophisticated electronic devices that have crowded circuit boards.

Another known solution in the art, to reduce both the EMI getting into the device and the EMI being emitted by the device, is the use of inline filters. The disadvantage to an inline filter is that it is an additional component, and whenever an additional component is added into an electronic system, especially systems operating at relatively low power, it can change the characteristics of the system, increasing the probability that it may sooner or more often begin to operate outside of its specification range. Another disadvantage to an inline filter is that it is an extra component which must be purchased and installed, costing money and time.

SUMMARY OF THE INVENTION

One object of the invention was to design a power supply connector which can be used to provide DC or AC power to an electronic device that operates at radio-frequencies.

A second object of the invention was to design a power supply connector that accomplished the first object and which also attenuated both conducted and radiated EMI, whether it was incoming or outgoing.

The objects of the invention are accomplished by constructing a power supply connector that is comprised of: a conductive outer shell that has a first open end and a second open end, and that has a continuous interior cavity between its two open ends; a dielectric support that has a first open end and a second open end, and that has a continuous inner cavity between its two open ends; wherein said dielectric support fits within the continuous interior cavity of the conductive outer shell such that the first open end of the dielectric support is proximate the first open end of the conductive outer shell and the second open end of the dielectric support is proximate the second open end of the conductive outer shell; a conductive means that has a first end and a second end, which conductive means is placed within the continuous interior cavity of the dielectric support such that its first end is proximate the first end of the conductive outer shell and its second end is proximate the second end of the conductive outer shell; a connecting closure means ("CCM") that has a non-conductive exterior wall, defined by a non-conductive circumferential material, in addition, the CCM has a first conductive area that is interior of and adjacent to the non-conductive circumferential material, in further addition the CCM has an interior non-conductive area that is interior of and adjacent to the first conductive area, and a second conductive area which is interior of and adjacent to the interior non-conductive area, wherein the interior non-conductive area separates and electrically isolates the first conductive area from the second conductive area, in further addition, the second conductive area has a central opening which the second end of the conductive means fits through; wherein after the second end of the conductive means has been placed through the central opening in the second conductive area of the CCM a conductive connection is made between the second conductive area of the CCM and the second end of the conductive means; wherein the CCM's non-conductive exterior wall fits within and is placed within the second open end of the conductive outer shell; and wherein a conductive connection is made between the CCM's first conductive area and the conductive outer shell; and an EMI filtering means, which is conductively connected between the first conductive area of the CCM and the second conductive area of the CCM.

In the above described embodiment of the invention, it is preferred that there is no gap between the non-conductive exterior wall of the CCM and the area adjacent the second opening of the conductive outer shell into which the CCM was placed, and it is preferred that the CCM itself has no gaps within it other than the central opening in its second conductive area, and it is preferred that there are no gaps between the second end of the conductive means and central opening in the second conductive area of the CCM after the insertion of the second end of the conductive means into said central opening. The absence of gaps will result in an environmental seal, which, in the area of the environmental seal, tends to prevent elements that are often present in the environment, such as moisture, dust and other particles, from entering the device being powered.

The first conductive area of the CCM provides attenuation of radiated EMI, and the EMI filtering means connected between the first and second conductive areas of the CCM provides attenuation for conducted EMI. A gap free electrical connection (as contrasted to one which has gaps) of the first conductive area will enhance its ability to attenuate radiated EMI. Similarly, a gap free electrical connection of the EMI filtering means will enhance its ability to attenuate conducted EMI.

In operation, the invented EMI filtering coaxial power connector is installed in the device to be powered by having the second end of the conductive means connected with the power input of the device to be powered, and then the power supply is connected to the first end of the conductive means. The power would then pass through the first end of the conductive means and then into the device to be powered from the second end of the conductive means. The dielectric support keeps the conductive means from coming into electrical contact with the conductive outer shell.

The objects of the invention are also accomplished by a preferred embodiment of the instant invention of a power supply connector that is comprised of: a conductive outer shell that has a first open end and a second open end, and a continuous interior cavity between said open ends; and a dielectric support made up of an open ended dielectric support body with a continuous interior cavity and an open ended dielectric support cap with a continuous interior cavity; and a conductive means with a first end and a second end; and a filter PCB which has a ground plane and a center pad that are electrically isolated from each other, wherein the center pad has a central opening for the second end of the conductive means to fit through; and an EMI filtering means that is conductively connected between the ground plane and center pad of the filter PBC; and an environmental sealing means between the EMI filtering coaxial power connector's conductive outer shell and the housing of the electronic device to be powered, which environmental sealing means tends to prevent the entry of elements that are often present in the environment, such as moisture, dust and other particles.

When assembled the dielectric support body is fitted in the continuous interior cavity of the connector's outer shell such that the end of the dielectric support body through which the second end of the conductive means will extend is proximate the second open end of the conductive outer shell; and the conductive means is fitted in the dielectric support body such that a portion of the second end of the conductive means extends beyond the open end of the dielectric support that is proximate the second open end of the conductive outer shell; the dielectric support cap is placed over the first end of the conductive means until it is in contact with the complimentary portion of the dielectric support body; and the filter PCB is inserted into the conductive outer shell through its second open end, until the ground plane of the filter PCB is proximate the conductive outer shell's open end, such that the central opening of the center pad of filter PCB is concentric with the second end of the conductive means; wherein the filter PCB has no gaps except for the central opening in its center pad; a gap free solder joint is made completely around the portion of the second end of the conductive means that is concentric with the central opening of the center pad of the filter PCB, such that the solder joint provides an environmental seal and electrical connection between the second end of the conductive means and the center pad of the filter PCB; though other shapes may be used, the preferred shapes of the cross-section of the conductive means and of the central opening of the center pad of the filter PCB are round; a gap free solder joint is also made between the ground plane of the filter PCB and the conductive outer shell, where they are most proximate each other, such that the gap free solder joint provides an environmental seal and an electrical connection between the ground plane of the filter PCB and the conductive outer shell.

In the above described preferred embodiment of the invention the gap free solder joints-provide environmental seals and provide very good electrical conductivity between the elements which are electrically connected by those gap free solder joints, which allows those elements to perform their intended functions better than if there were gaps in the solder joints. The ground plane attenuates radiated EMI. A gap free solder joint will provide a better electrical contact with the connector's outer shell, than would a solder joint that was not gap free, and hence a gap free solder joint, as compared to a solder joint with gaps, will allow the ground plane to better attenuate any radiated EMI. The EMI filtering means connected between the ground plane and the center pad of the filter PCB provides attenuation for conducted EMI, and its ability to perform its function will be enhanced by a gap free joint.

In operation, the invented EMI filtering coaxial power connector is installed in the device to be powered by having the second end of the conductive means connected with the power input of the device to be powered, and then the power supply is connected to the first end of the conductive means. The power would then pass through the first end of the conductive means and then into the device to be powered from the second end of the conductive means. The dielectric support body and open ended dielectric support cap keep the conductive means from coming into electrical contact with the conductive outer shell.

DETAILED DESCRIPTION OF THE PREFERRED EMBODIMENTS

Figure 1:
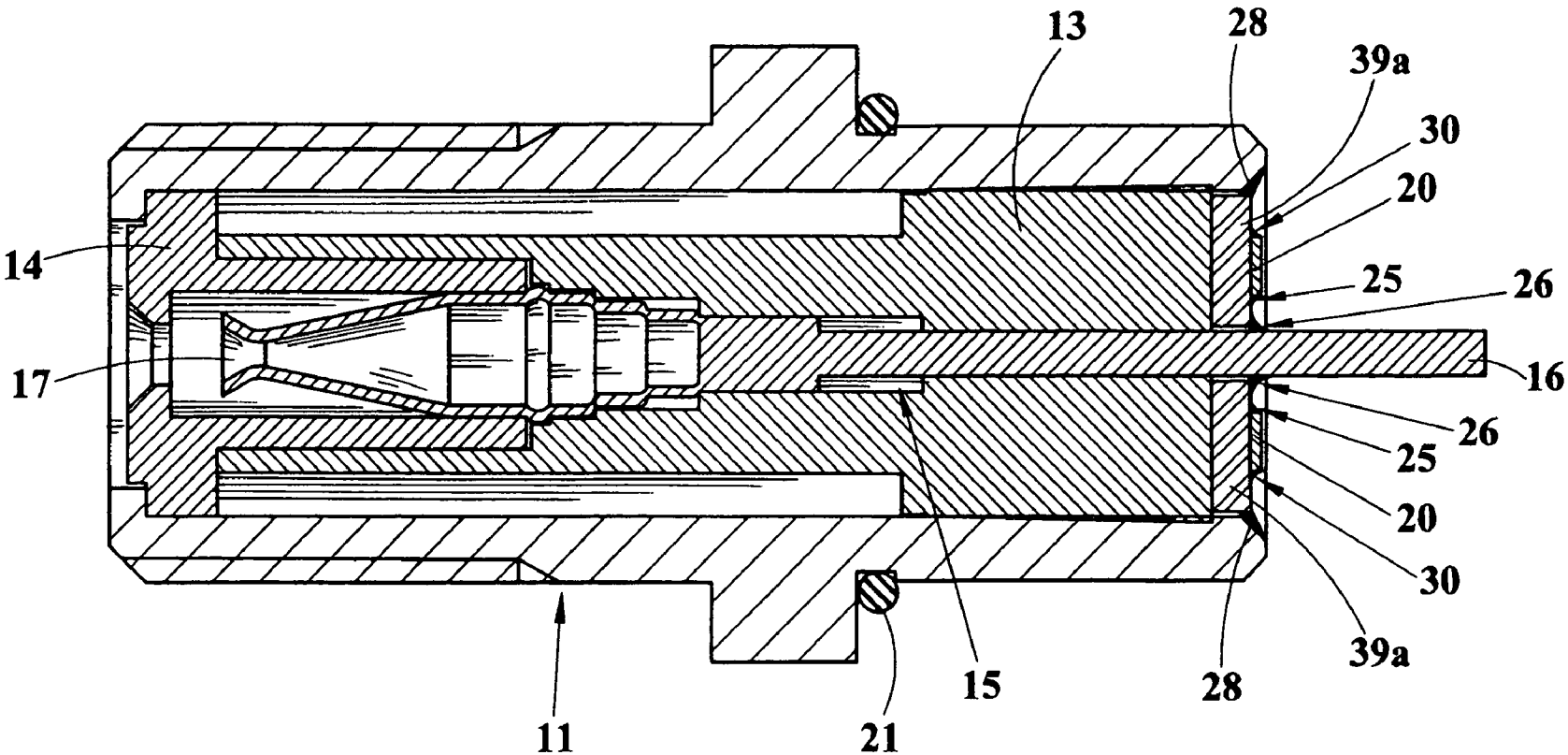
FIG. 1 is a cross section of a preferred embodiment of an EMI filtering coaxial power connector according to the invention.
Figure 2:
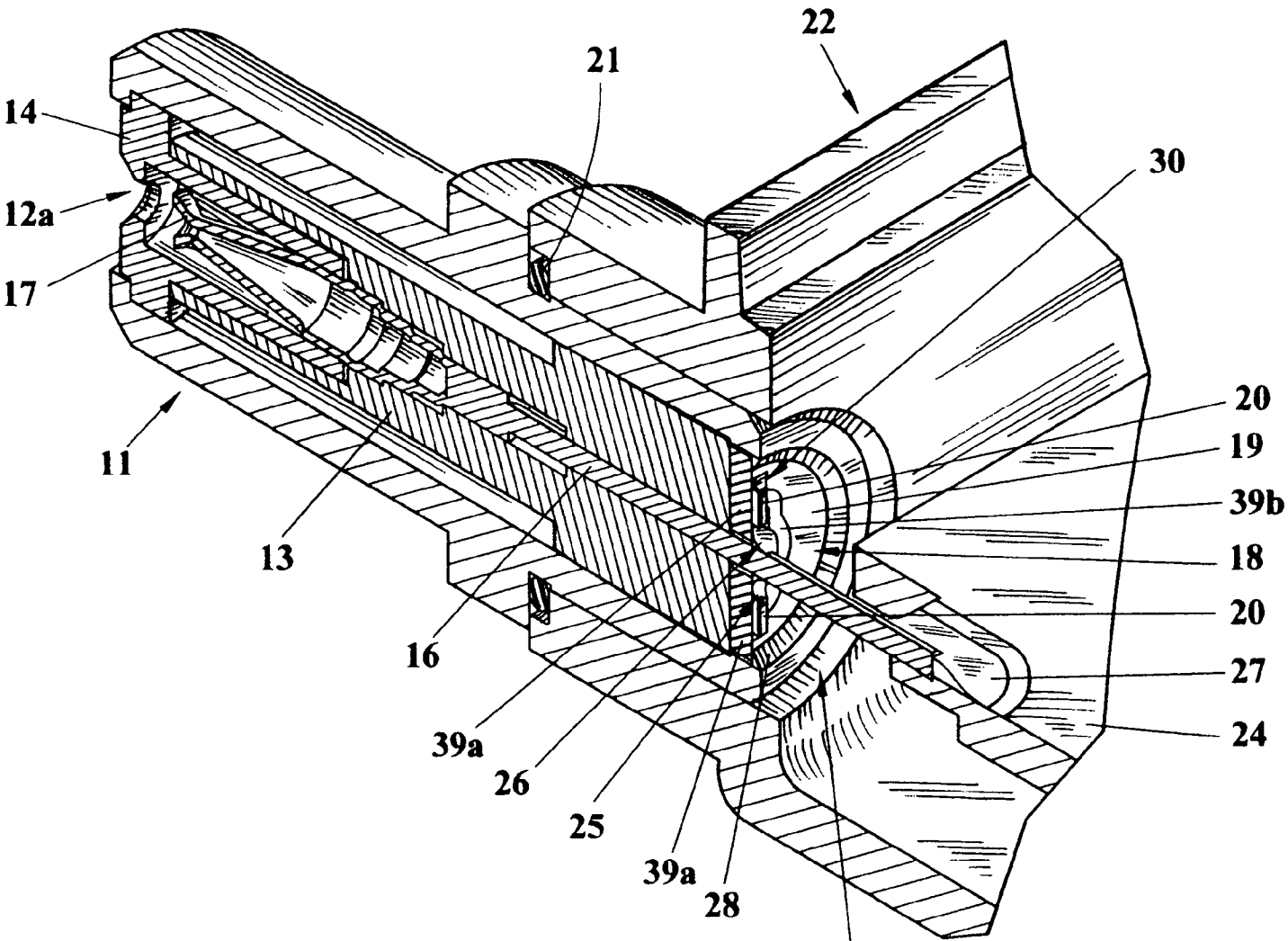
FIG. 2 is a cut away perspective view of the EMI filtering coaxial power connector shown in FIG. 1, connected within the housing of an electronic device.
Figure 3A:
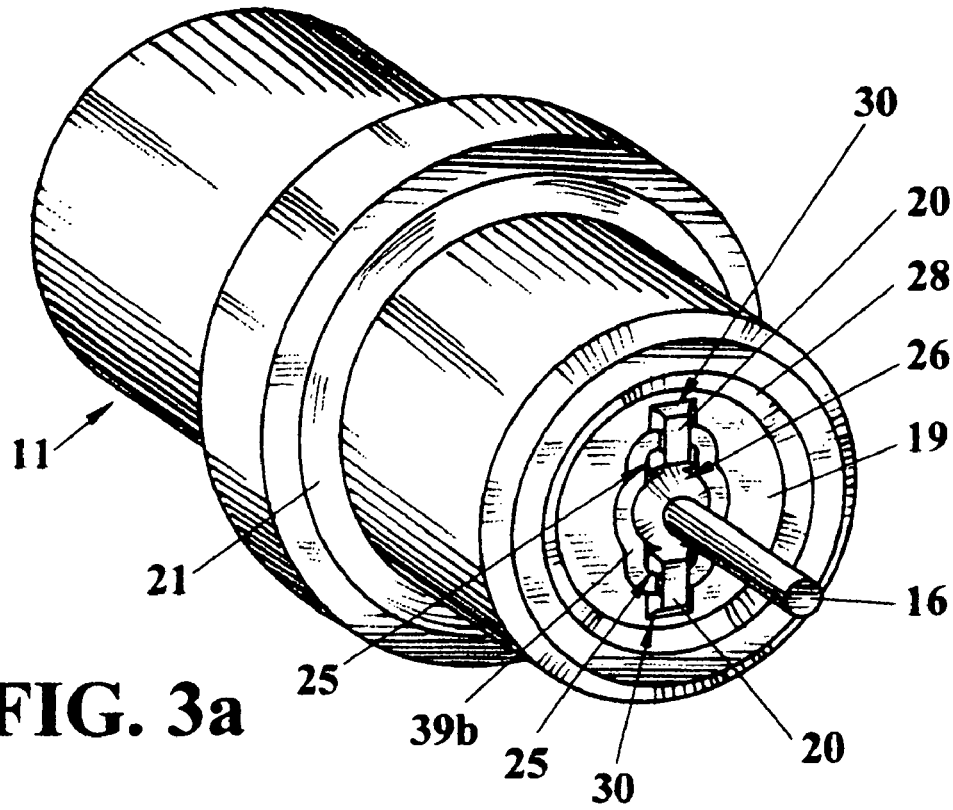
FIG. 3*a* is a perspective view of the EMI filtering coaxial power connector shown in FIG. 1.
Figure 4C:
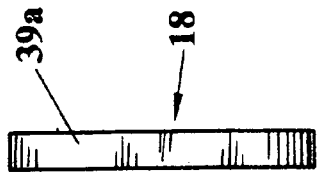
FIG. 4*c* is a side view of a single-sided filter PCB of the type used in the preferred embodiment of an EMI filtering coaxial power connector shown in FIG. 1.
Figure 4B:
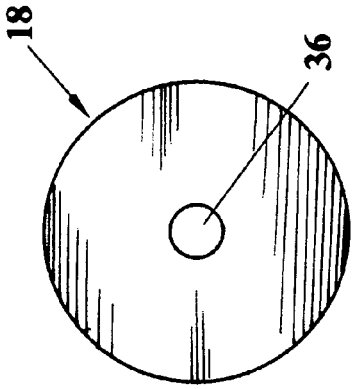
FIG. 4*b* is a bottom view of a single-sided filter PCB of the type used in the preferred embodiment of an EMI filtering coaxial power connector shown in FIG. 1.
Figure 4A:
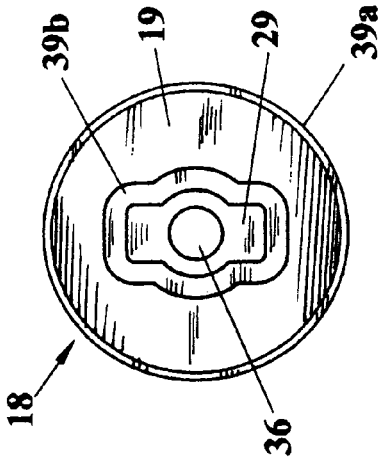
FIG. 4*a* is a top view of a single-sided filter PCB of the type used in the preferred embodiment of an EMI filtering coaxial power connector shown in FIG. 1.

FIG. 1 shows a preferred embodiment of an EMI filtering coaxial power connector of the present invention. FIG. 2 shows a cut away perspective view of the EMI filtering coaxial power connector shown in FIG. 1, as it would appear when it is connected within the housing of an electronic device; and FIG. 3*a* shows a perspective view of the EMI filtering coaxial power connector shown in FIG. 1. In FIG. 2, the illustrated portions of the electronic device, such as the housing 22, and the PCB 24, are not part of the invention. The preferred embodiment of the invention shown in FIGS. 1, 2 and 3*a*, is made up of: (i) a conductive outer shell 11, that has a first open end 12*a*, and a second open end 12*b*, and a continuous interior cavity between its first open end and its second open end; and (ii) an open ended dielectric support made up of an open ended dielectric support body 13, which has a continuous interior cavity between its open ends, and an open ended dielectric support cap 14 which also has a continuous interior cavity between its two open ends; wherein when the open ended dielectric support cap 14 is placed onto the open ended dielectric support body 13, their continuous interior cavities will communicate with each other; and (iii) a conductive means 15, which in this embodiment is made up of a center conductor pin 16, and a female contact end 17; and (iv) a single-sided filter PCB 18, which has a ground plane 19 and a center pad, and which filter PCB 18 has no gaps in it, except that its center pad has a central opening (in FIG. 4*a* the center pad 29 and its central opening 36 can be seen), the central opening 36 is for the center conductor pin 16 to fit through, in addition the filter PCB has a non-conductive material 39*b* that electrically isolates the ground plane 19 and the center pad 29 and a non-conductive circumferential material 39*a*; and (v) an EMI filtering means, which in the embodiment illustrated in FIGS. 1, 2 and 3*a* are the two capacitors 20; and (vi) an environmental sealing means, which in this embodiment is an O-ring 21, which provides an environmental seal between the conductive outer shell 11 and the housing of the electronic device to be powered, such as the housing shown at 22.

The capacitors 20 provide attenuation for conducted EMI. It is not essential that two capacitors be used, a single capacitor could be used and it would provide attenuation of conducted EMI, however, not as effectively as does two capacitors. The use of more than two capacitors, connected in parallel, would provide an even greater attenuation of conducted EMI than is provided by two capacitors; however, at an increased cost in parts and labour. Therefore, to achieve a relatively high degree of attenuation of conducted ESI without the increased cost (of more capacitors) in the preferred embodiments of the invention 2 capacitors are used.

The O-ring as at 21 is the preferred means of creating an environmental seal in the above discussed preferred embodiment, however, other means could be used. An example of another means that could be used instead of an O-ring is a gel like substance that hardens after it is applied. If means other than an O-ring are used, and they are not as effective as an O-ring, then the device may not operate as efficiently and/or effectively as the discussed preferred embodiment; however, it would still function.

The preferred order of assembly for the preferred embodiment is to: (i) first fully insert the center conductor pin 16 into the dielectric support body 13, which will result in a portion of the center conductor pin 16 extending beyond the open end of the dielectric support body 13; then (ii) place the dielectric support cap 14 completely onto the dielectric support body; next (iii) insert the assembled dielectric support cap and dielectric support body (with the center conductor pin inside) into the conductive outer shell 11 until the end of the dielectric support cap 14 which is to be proximate the first open end 12*a* of the conductive outer shell contacts the inner portion of the defining wall of the first open end of the conductive outer shell 12*a*; then (iv) insert the single-sided filter PCB 18 such that the central opening 36 of the single-sided filter PCB is concentric with the center conductor pin 16 and such that the single-sided filter PCB's circumference comes into contact with the conductive outer shell 11 proximate the conductive outer shell's open end 12*b*, and solder the single-sided filter PCB 18 into place, making a gap free conductive connection between its ground plane 19 and the conductive outer shell 11, and making a separate gap free solder joint conductive connection between the filter PCB's center pad 29 and the center conductor pin 16; next (v) for each of the two capacitors 20, one end of the capacitor is soldered to the filter PCB center pad, as at 25, and the other end of the capacitor is soldered to the filter PCB ground plane as at 30; and finally (vi) install the O-ring 21.

Alternate orders of assembly are also possible, for example only: (i) install the O-ring 21; then (ii) insert the dielectric support cap 14 completely into the conductive outer shell 11 until the end of the dielectric support cap 14, which is to be proximate the first open end 12*a* of the conductive outer shell, contacts the inner portion of the defining wall of the first open end of the conductive outer shell 12*a*; next (iii) fully insert the center conductor pin 16 into the dielectric support body 13, which will result in a portion of the center conductor pin 16 extending beyond the open end of the dielectric support body 13; then (iv) take the dielectric support body with the inserted center conductor pin and insert that dielectric support body 13 into the conductive outer shell until it forms a fitted connection with the dielectric support cap 14; next (v) insert the single-sided filter PCB 18 such that the central opening 36 of the single-sided filter PCB is concentric with the center conductor pin 16 and such that the single-sided filter PCB's circumference comes into contact with the conductive outer shell 11 proximate the conductive outer shell's open end 12*b*, and solder the single-sided filter PCB 18 into place, making a gap free conductive connection between its ground plane 19 and the conductive outer shell 11, and making a separate gap free solder joint conductive connection between the filter PCB's center pad 29 and the center conductor pin 16; and finally (vi) for each of the two capacitors 20, one end of the capacitor is soldered to the filter PCB center pad, as at 25, and the other end of the capacitor is soldered to the filter PCB ground plane as at 30.

The preferred shapes of the cross-section of the center conductor pin 16 and of the central opening 36 of the single-sided filter PCB are round, as that facilitates the manufacturing of the invention as round holes are easy to make and pins having a round cross section are easy to produce. In addition, it is easier to apply a gap free solder joint to an open area without corners, such as the area created by inserting a round (cross section) pin in a round hole; and the gap free solder joint provides an environmental seal. Other complimentary or dissimilar shapes could be used for the central opening in the single-sided filter PCB and for the cross-section of the center conductor pin 16, and it would also be possible to form a gap free solder joint between a differently shaped center conductor pin and a differently shaped single-sided filter PCB central opening. Therefore, having a center conductor pin which does not have a round cross-section is still within the teaching of the invention, and having a central opening in the single-sided filter PCB that is not round is also still within the teaching of the invention, however, because of the greater difficulty in producing and using them, they are not part of a preferred embodiment of the invention. In addition, while solder is the preferred method of making the joint, it is not essential, as long as there is a conductive contact the parts will perform their function. For example, when electrical conduction is needed between the elements being joined or connected by a solder joint, instead of a solder joint, a conductive epoxy could be used to make a joint or to fill a gap.

It is also preferred, though not essential, that when the EMI filtering coaxial power connector is inserted into the housing of the device to be powered, that the portion of the center conductor pin 16 that extends beyond the open end of the dielectric support body 13, is soldered without any gaps to the portion of the device to be powered with which it is making electrically conductive contact, as at 27.

In the above described construction and assembly of a preferred embodiment of the invention, the gap free solder joints 26 and 28, as stated, are environmental seals, and in addition, as explained above, gap free solder joints enhance the relevant components ability to attenuate both incoming and outgoing EMI. If those solder joints were not gap free, the invention would still function, however, it may not provide as effective an attenuation of EMI, as when those solder joints are gap free.

In operation, after the invented EMI filtering coaxial power connector has been installed in the device to be powered, a power plug would be inserted through the first open end 12*a* into the female contact end 17. The power would then pass through the female contact end 17 into the center conductor pin 16, and then into the device to be powered. The dielectric support body 13 and open ended dielectric support cap 14 keep the female contact end 17 and the center conductor pin 16 from coming into electrical contact with the conductive outer shell 11.

Figure 3B:
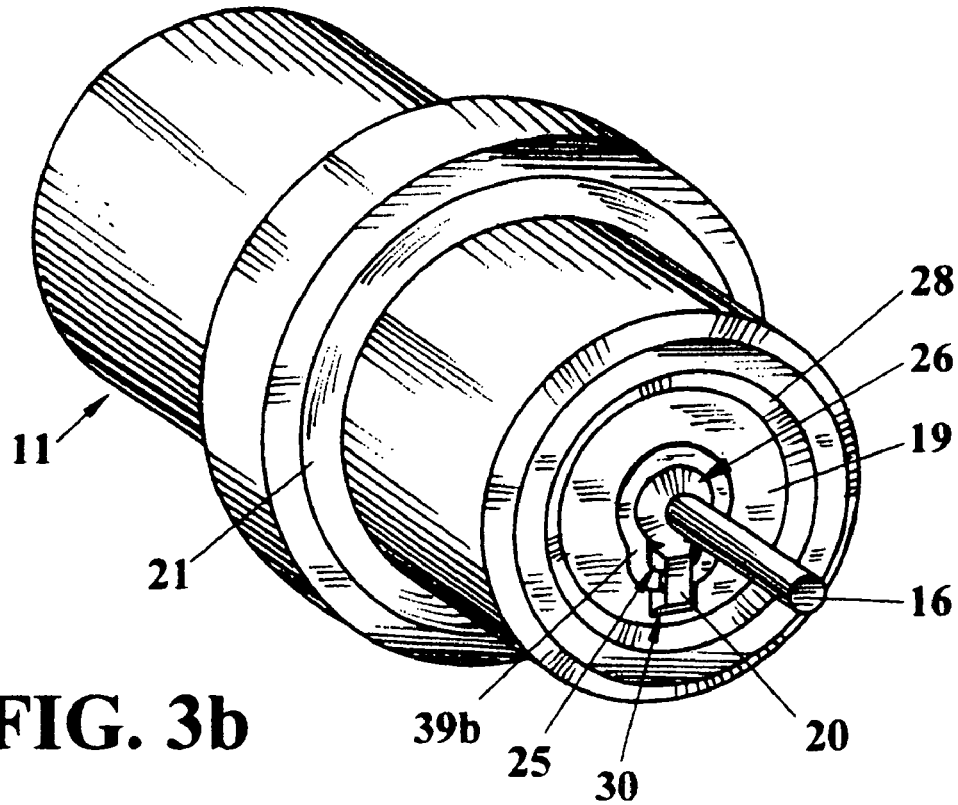
FIG. 3*b* is a perspective view of an EMI filtering coaxial power connector that would be the same as shown in FIG. 1, except that in this embodiment of an EMI filtering coaxial power connector there is only one capacitor.

FIG. 3*b* illustrates an embodiment that is not a preferred embodiment, FIG. 3*b* illustrates an embodiment of the invention that only uses one capacitor, other than that it is the same as the preferred embodiment illustrated in FIGS. 1, 2 and 3*a*.

Figure 5C:
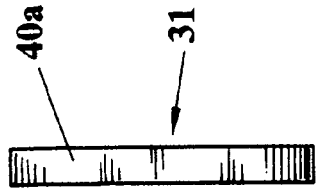
FIG. 5*c* is a side view of a double-sided filter PCB of the type that could be used in a preferred embodiment of an EMI filtering coaxial power connector similar to the one shown in FIG. 1.
Figure 5B:
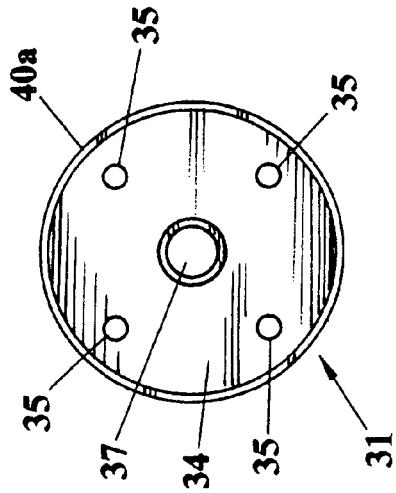
FIG. 5*b* is a bottom view of a double-sided filter PCB of the type that could be used in a preferred embodiment of an EMI filtering coaxial power connector similar to the one shown in FIG. 1.
Figure 5A:
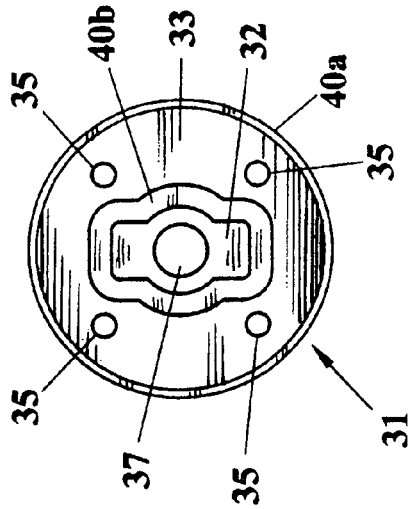
FIG. 5*a* is a top view of a double-sided filter PCB of the type that could be used in a preferred embodiment of an EMI filtering coaxial power connector similar to the one shown in FIG. 1.

FIGS. 5*a*, 5*b* and 5*c* show a double-sided filter PCB. It could be used in a preferred embodiment of the invention such as the one discussed above in place of the single-sided filter PCB. Similar to the single-sided filter PCB 18, the double-sided filter PCB 31 of FIGS. 5*a*, 5*b* and 5*c*, has a center pad 32, with a center hole 37, an exterior circumferential non-conductive material 40*a*, a ground plane with a top side 33 and a bottom side 34, and an interior non-conductive material 40*b*, that electrically isolates the ground plane from the center pad. However, the double-sided filter PCB 31 also has conductive plated holes 35, which the single-sided filter PCB 18 does not have.

Figure 6:
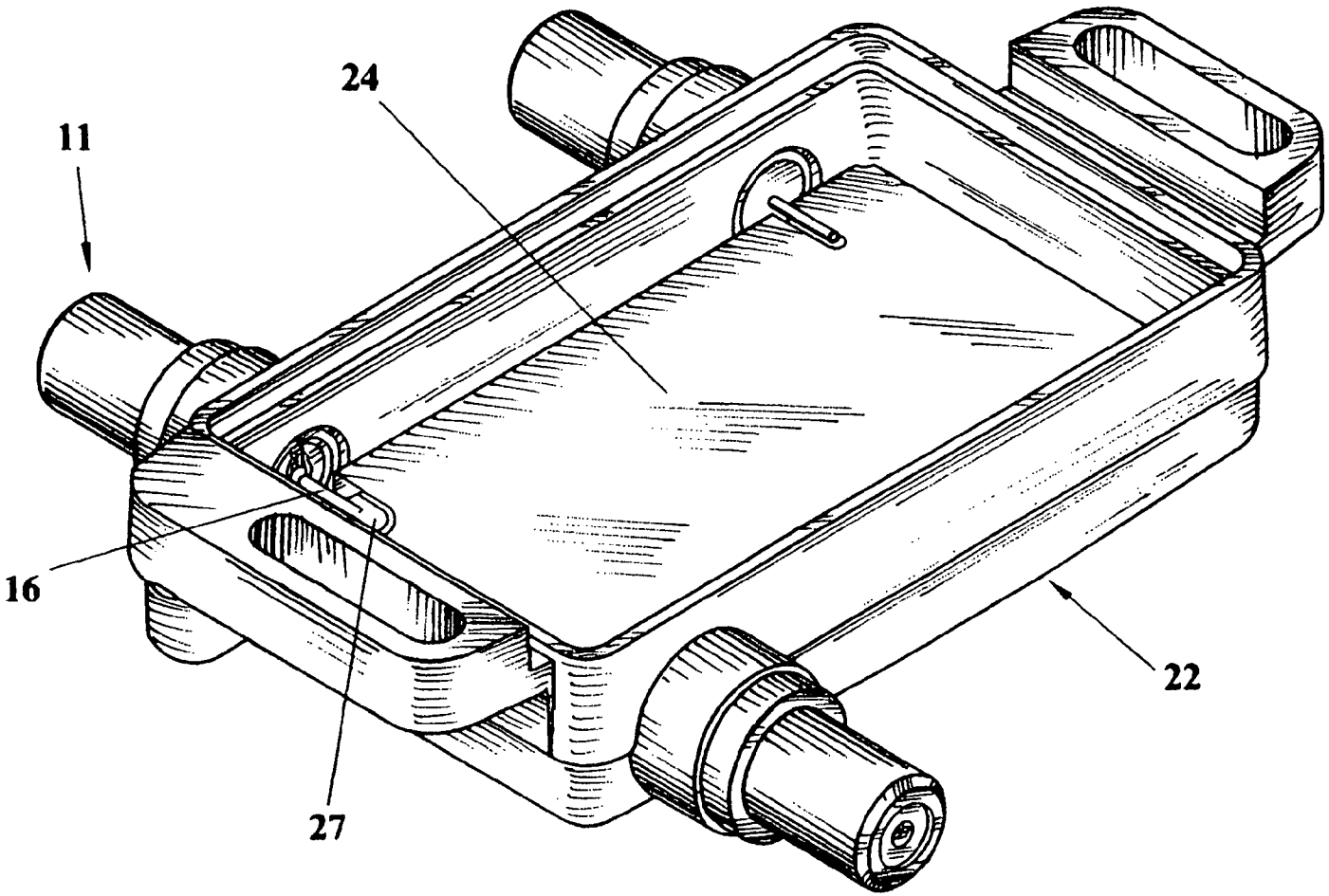
FIG. 6 is a partially cut away perspective view of the EMI filtering coaxial power connector shown in FIG. 1, connected within the housing of an electronic device.

FIG. 6 (in a partially cut away view) shows what an EMI filtering coaxial power connector of the present invention might look like connected within the housing of an electronic device.

Figure 7:
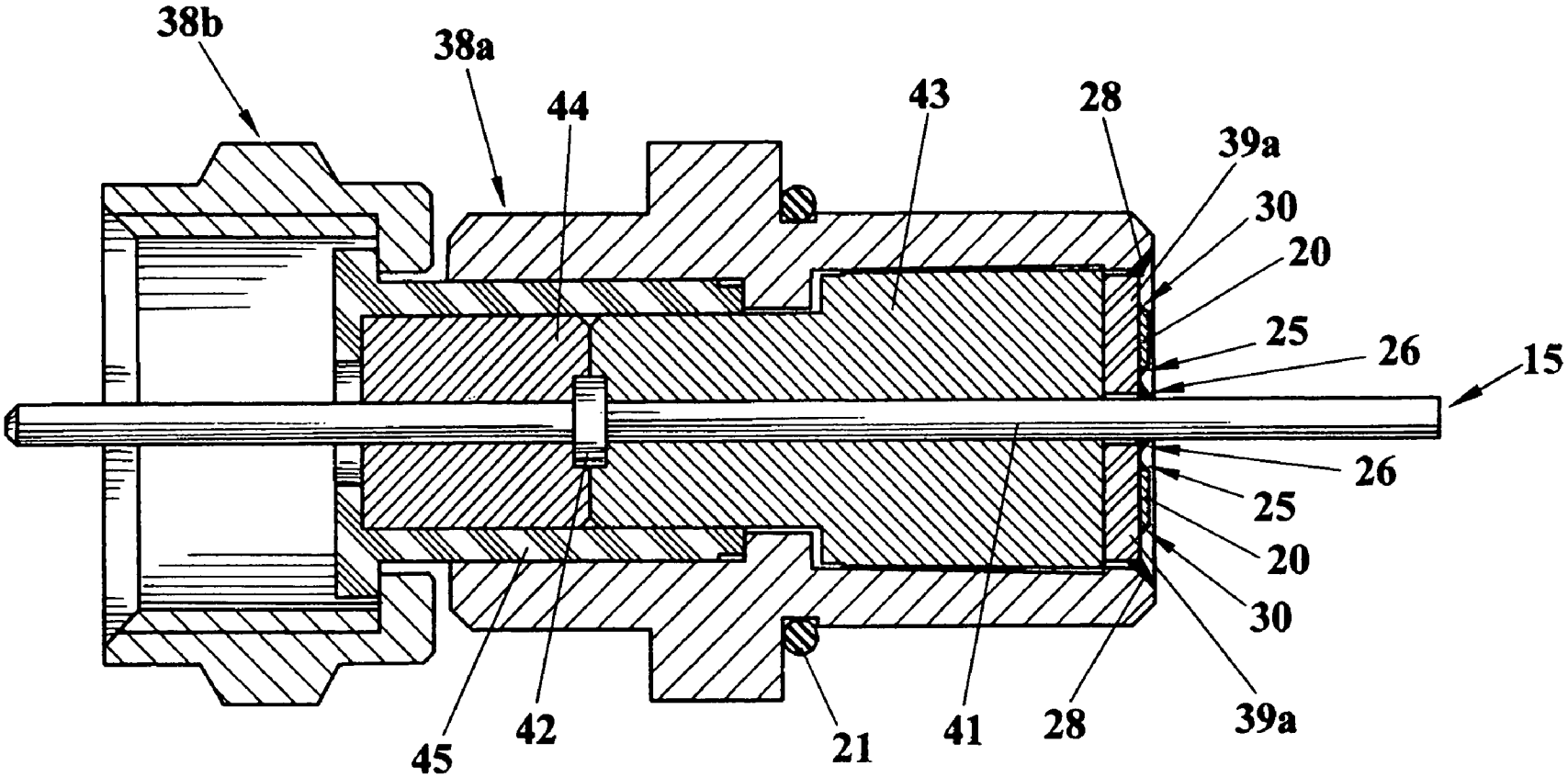
FIG. 7 is a cross section of a another preferred embodiment of an EMI filtering coaxial power connector according to the invention.

FIG. 7 shows a cross section of a preferred embodiment of an EMI filtering coaxial power connector according to the invention in which the conductive means 15 is comprised of a center conductor 41 and does not include a female contact end such as the female contact end 17 illustrated in FIGS. 1, 2 and 3*a*.

The preferred embodiment of the invention shown in FIG. 7 is made up of: (i) a conductive outer shell which has two parts, a conductive outer shell body 38*a* and a conductive outer shell cap 38*b*, wherein the conductive outer shell body 38*a* has a first open end and a second open end and a continuous inner cavity between its two open ends, and which conductive outer shell body 38*a* has a separate inner portion 45 that extends from approximately its mid point to become and define the second open end of the outer shell body 38*a*, at which point said inner portion 45 (and hence the second open end of the outer shell body 38*a*) ends in a flange that projects at right angles both inwardly and outwardly from the main body of said inner portion 45, and wherein the conductive outer shell cap 38*b* has a first open end and a second open end and a continuous inner cavity between its two open ends, and wherein the first open end of the conductive outer shell cap 38*b* connects with the second open end of the conductive outer shell body 38*a* interior of its aforesaid flange; and (ii) an open ended dielectric support made up of: (a) an open ended dielectric support body 43 that has a continuous inner cavity between its two open ends, and which open ended dielectric support body ends in a first open end of the same cross section as said continuous inner cavity and in a second open end having a larger cross section than said continuous inner cavity, and (b) an open ended dielectric support cap 44 that has a continuous inner cavity between its two open ends, and which open ended dielectric support cap ends in a first open end of the same cross section as said continuous inner cavity and in a second open end having a larger cross section than said continuous inner cavity; wherein when the second open end of the open ended dielectric support cap 44 is placed adjacent the second open end of the open ended dielectric support body 43 their continuous interior cavities will communicate with each other and their larger cross section second open ends will form a cavity of a specific shape; and (iii) a conductive means 15, which in this embodiment is a center conductor 41 which has an interior portion 42 that will fit within the cavity of a specific shape that is formed when the two larger cross section second open ends of the dielectric support cap 44 and the dielectric support body 43 are placed adjacent each other; and (iv) a single-sided filter PCB like the single-sided filter PCB 18 shown in FIGS. 4*a* to 4*c*, which has a ground plane 19 and a center pad 29 with a central opening 36, and which filter PCB has no gaps in it, except for the central opening in its center pad, which central opening is for a portion of the center conductor 41 to fit through, in addition the filter PCB has a non-conductive material that electrically isolates its ground plane from the center pad, and a non-conductive circumferential material; and (v) an EMI filtering means, which in the embodiment illustrated in FIG. 7 are the two capacitors 20; and (vi) an environmental sealing means, which in this embodiment is an O-ring 21, which provides an environmental seal between the conductive outer shell and the housing of the electronic device to be powered.

The capacitors 20 provide attenuation for conducted EMI. It is not essential that two capacitors be used, a single capacitor could be used and it would provide attenuation of conducted EMI, however, not as effectively as does two capacitors. The use of more than two capacitors, connected in parallel, would provide an even greater attenuation of conducted EMI than is provided by two capacitors; however, at an increased cost in parts and labour. Therefore, to achieve a relatively high degree of attenuation of conducted EMI without the increased cost (of more capacitors) in the preferred embodiments of the invention 2 capacitors are used.

The O-ring as at 21 is the preferred means of creating an environmental seal in the above discussed preferred embodiment, however, other means could be used. An example of another means that could be used instead of an O-ring is a gel like substance that hardens after it is applied. If means other than an O-ring are used, and they are not as effective as an O-ring, then the device may not operate as efficiently and/or effectively as the discussed preferred embodiment; however, it would still function.

I claim:

1. An EMI filtering coaxial power connector for electronic devices, comprised of:

(a) a conductive outer shell that has a first open end and a second open end, and that has a continuous inner cavity between its two open ends;

(b) a dielectric support that has a first open end and a second open end and that has a continuous inner cavity between its two open ends, which dielectric support is comprised of: (i) a dielectric support body that has a first open end and a second open end, which second open end is the second open end of the dielectric support, and which dielectric support body has a continuous interior cavity between its two open ends; and (ii) a complimentary dielectric support cap that has a first open end, which first open end is the first open end of the dielectric support, and which dielectric support cap has a second open end, and which dielectric support cap has a continuous interior cavity between its two open ends;

(c) wherein said dielectric support fits within the continuous inner cavity of the conductive outer shell such that the first open end of the dielectric support cap communicates with the first open end of the conductive outer shell and the second open end of the dielectric support body communicates with the second open end of the conductive outer shell;

(d) a conductive means that has a first end and a second end, which conductive means is placed within the continuous interior cavity of the dielectric support such that after the dielectric support has been placed in the continuous inner cavity of the conductive outer shell the first end of the conductive means is proximate the first end of the conductive outer shell and the second end of the conductive means is proximate the second end of the conductive outer shell;

(e) a filter PCB that has a non-conductive exterior wall, defined by a non-conductive circumferential material, and which filter PCB has a first conductive area that is interior of and adjacent to the non-conductive circumferential material, and which filter PCB has an interior non-conductive area that is interior of and adjacent to the first conductive area, and which filter PCB has a second conductive area which is interior of and adjacent to the interior non-conductive area, wherein the interior non-conductive area separates and electrically isolates the first conductive area from the second conductive area, and wherein the second conductive area has a central opening which the second end of the conductive means fits through;

(f) wherein the filter PCB's non-conductive exterior wall fits within and is placed within the second open end of the conductive outer shell;

(g) wherein after the second end of the conductive means has been placed through the central opening in the second conductive area of the filter PCB a conductive connection is made between the second conductive area of the filter PCB and the second end of the conductive means;

(h) wherein after the filter PCB's non-conductive exterior wall has been placed within the second open end of the conductive outer shell a conductive connection is made between the filter PCB's first conductive area and the conductive outer shell; and (i) an EMI filtering means, which is conductively connected between the first conductive area of the filter PCB and the second conductive area of the filter PCB.

2. An EMI filtering coaxial power connector for electronic devices as described in claim 1, in which the conductive means is comprised of a female contact end and a center conductor pin; wherein the center conductor pin is the second end of the conductive means.

3. An EMI filtering coaxial power connector for electronic devices as described in claim 1, in which the conductive means is comprised of a center conductor.

4. An EMI filtering coaxial power connector for electronic devices as described in claim 1; wherein the first conductive area of the filter PCB is a ground plane and the second conductive area of the filter PCB is a center pad.

5. An EMI filtering coaxial power connector for electronic devices as described in claim 1; wherein the conductive connection between the second conductive area of the filter PCB and the second end of the conductive means is gap free; and wherein the conductive connection between the filter PCB's first conductive area and the conductive outer shell is gap free.

6. An EMI filtering coaxial power connector for electronic devices as described in claim 1; wherein the EMI filtering means that is conductively connected between the first conductive area of the filter PCB and the second conductive area of the filter PCB is comprised of at least one capacitor.

7. An EMI filtering coaxial power connector for electronic devices as described in claim 1; wherein the conductive connection between the second conductive area of the filter PCB and the second end of the conductive means is gap free; and wherein the conductive connection between the filter PCB's first conductive area and the conductive outer shell is gap free; and wherein the EMI filtering means that is conductively connected between the first conductive area of the filter PCB and the second conductive area of the filter PCB is comprised of at least one capacitor.

8. An EMI filtering coaxial power connector for electronic devices as described in claim 1; which is also comprised of an environmental sealing means around a portion of the perimeter of the conductive outer shell that will provide an environmental seal between the conductive outer shell and the housing of the electronic device in which the EMI filtering coaxial power connector is used; and wherein the EMI filtering means that is conductively connected between the first conductive area of the filter PCB and the second conductive area of the filter PCB is comprised of at least one capacitor.

9. An EMI filtering coaxial power connector for electronic devices as described in claim 1; in which the conductive means is comprised of a center conductor; and wherein the conductive connection between the second conductive area of the filter PCB and the second end of the conductive means is gap free; and wherein the conductive connection between the filter PCB's first conductive area and the conductive outer shell is gap free; and wherein the EMI filtering means that is conductively connected between the first conductive area of the filter PCB and the second conductive area of the filter PCB is comprised of at least one capacitor.

10. An EMI filtering coaxial power connector for electronic devices as described in claim 1; which is also comprised of an environmental sealing means around a portion of the perimeter of the conductive outer shell that will provide an environmental seal between the conductive outer shell and the housing of the electronic device in which the EMI filtering coaxial power connector is used; and in which the conductive means is comprised of a center conductor; and wherein the conductive connection between the second conductive area of the filter PCB and the second end of the conductive means is gap free; and wherein the conductive connection between the filter PCB's first conductive area and the conductive outer shell is gap free; and wherein the EMI filtering means that is conductively connected between the first conductive area of the filter PCB and the second conductive area of the filter PCB is comprised of at least one capacitor.

* * * * *